US005658130A

United States Patent [19]

Goldstein et al.

[11] Patent Number: 5,658,130

[45] Date of Patent: Aug. 19, 1997

[54] OSCILLATING WINDOW FAN

[75] Inventors: Andrew Goldstein, Newton; David Feer, Andover; Robert Barker, Lunenburg, all of Mass.

[73] Assignee: Holmes Products Corp., Milford, Mass.

[21] Appl. No.: 573,365

[22] Filed: Dec. 15, 1995

[51] Int. Cl.[6] ..... F01D 7/00

[52] U.S. Cl. ..... 416/100; 415/60; 454/210

[58] Field of Search ..... 415/60, 125, 141; 416/100; 454/207, 208, 210

[56] References Cited

U.S. PATENT DOCUMENTS

| | | | |
|---|---|---|---|
| 2,452,950 | 11/1948 | Morrison | 454/210 |
| 2,456,391 | 12/1948 | Davies . | |
| 2,786,627 | 3/1957 | Hopper | 454/208 |
| 3,722,395 | 3/1973 | Courchesne . | |
| 3,727,537 | 4/1973 | Harty, Jr. . | |
| 4,743,739 | 5/1988 | Tateishi . | |
| 4,773,310 | 9/1988 | Corwin | 454/210 |
| 4,972,570 | 11/1990 | Tateishi . | |
| 5,000,381 | 3/1991 | Mueller et al. | 454/208 |
| 5,092,186 | 3/1992 | Frank . | |
| 5,287,585 | 2/1994 | Yamamoto et al. . | |
| 5,425,247 | 6/1995 | Hatano . | |

*Primary Examiner*—John T. Kwon
*Attorney, Agent, or Firm*—Hoffmann & Baron

[57] ABSTRACT

A window mounted oscillating fan. The fan has two blower modules each having a motor, fan blade, and diffuser. The diffuser is fixed in a stationary position relative to its fan blade. The window fan oscillates by pivoting all blower modules simultaneously through a single motorized oscillation mechanism. The blower units may be arranged to discharge air in parallel, or alternatively, in different directions. The blower units pivot about an axis inclined from the vertical, so that oscillation has a vertical component as well as horizontal. In different embodiments, the fans operate in tandem, facing the same direction at all times, or oscillate in different directions, thereby diffusing incoming air. The window fan has an air filter, and manual and automatic controls including a touch sensitive on-off switch, a thermostatic on-off switch, and a speed selector.

17 Claims, 5 Drawing Sheets

OSCILLATING WINDOW FAN

BACKGROUND OF THE INVENTION

1. Field of the Invention

The present invention relates to a window mounted oscillating fan. The fan and louver assembly oscillates as a unit, rather than having the fan stationary and the louver only oscillate. In a preferred embodiment, the novel fan has two fan and louver assemblies mounted abreast. These assemblies are oscillated in tandem by one oscillating mechanism.

2. Description of the Prior Art

Fans for ventilating of a room by air drawn from the outside have been proposed in the prior art. These fans are usually adapted to be placed in a window. For maximal effectiveness, fans may be provided with adjustable diffusers for directing discharged air in various directions.

U.S. Pat. No. 2,456,391, issued to Charles Davies on Dec. 14, 1948, is illustrative of this approach. The adjustable diffusers comprise a slatted drum surrounding two horizontally oriented squirrel cage blowers. The drum is rotatable to direct discharged air upwardly and downwardly. By contrast, the fan of the present invention varies the direction of air discharge throughout a horizontal plane. Also, the novel fan automatically oscillates, causing the direction of discharged air to sweep through an arc contained within the horizontal plane. The diffusers of Davies are fixed, and must be adjusted manually each time a new direction of discharge is desired.

Oscillation, or automatic adjustment of right to left air flow is featured in a forced air heater shown in U.S. Pat. No. 4,743,739, issued to Arthur K. Takeishi on May 10, 1988. This is accomplished by adjustable diffusers. The fan remains in one orientation. The drawback to this arrangement is that as adjustment becomes more pronounced, and the diffuser blades assume increasing angle to the direction of air discharged by the fan, air pressure decreases. For effectiveness at maximal possible angles, the fan must have far more power than it would need at an unmodified angle of discharge. Therefore, the fan must be wastefully powerful, or else output at maximal angles may be inadequate. By contrast, the fan and diffuser adjust as a unit in the novel oscillating window fan. The diffuser blades are never at an angle to the direction of discharged air in the novel window fan, and thus the novel fan suffers little output losses due to obstruction of air flow.

As mentioned above, most air moving equipment has manually adjusted diffusers which remain at constant orientation until the next adjustment. Illustrative of this equipment are U.S. Pat. No. 3,722,395, issued to Germain Courchesne on Mar. 27, 1973, U.S. Pat. No. 3,727,537, issued to Millard Fillmore Harty, Jr., on Apr. 17, 1973, and U.S. Pat. No. 4,972,570, issued to Art K. Tateishi on Nov. 27, 1990. The novel fan differs from these examples of the prior art in that the fan blade and its diffuser remain in constant relative position, the two moving in tandem when angular adjustment is made. Also, angular adjustment is automatic and continuous.

Examples of mechanisms for translating oscillating motion are shown in U.S. Pat. No. 5,092,186, issued to Karlheinz Frank on Mar. 3, 1992, U.S. Pat. No. 5,287,585, issued to Tokihiko Yamamoto et al. on Feb. 22, 1994, and U.S. Pat. No. 5,425,247, issued to Koji Hatano on Jun. 20, 1995. Although these mechanisms could be adapted to provide oscillation in the present invention, they illustrate only motion translation mechanisms. There is no suggestion that they be employed in a device having fans and diffusers maintained in constant relative position, as occurs in the present invention.

None of the above inventions and patents, taken either singly or in combination, is seen to describe the instant invention as claimed.

SUMMARY OF THE INVENTION

The present invention addresses a major drawback to prior art air moving appliances having air directing baffles or diffusers, namely that significant air flow pressure losses occur when air directing diffuser blades are turned at increasing angles to the direction of discharged air from the fan. This is accomplished by causing the fan and its diffuser to rotate as a unit when redirecting air flow.

More specifically in the field of window mounted ventilation fans, wherein several fans are mounted abreast, one oscillating mechanism oscillates the fans simultaneously. For window mounted fans, it is generally desirable to occupy as little of the window area as possible, in order to maintain unobstructed viewing area and to devote as large an area as possible to incoming natural light. A lower and wider fan height or profile is achieved by arranging two or more relatively small fans abreast, rather than having a single large fan.

Another consideration is that for effective ventilation of an entire room, it is frequently desired to cause the fan to oscillate, or sweep through an arc, thereby discharging air in many different directions. The arcuate motion is periodically repeated automatically. This characteristic is well known in free standing fans, wherein no accommodation need be made for displacement of a fan and its grille. In the present invention, this characteristic is provided in a window fan having a stationary surrounding housing for supporting the fan in a window.

Several fans are oscillated either in tandem or at different angles by one oscillating mechanism. Thus, the several fans present in the novel window fan ventilate a room by drawing in exterior air, they oscillate, and they lose little effectiveness or output to diffuser angle when oscillating. This allows the fan motor to be of minimal size, and to produce minimal noise, while maintaining air flow at all angles while sweeping through an arcuate motion.

In a further development, air distribution is made even by optionally being directed in several directions simultaneously. This is accomplished by arranging the fans at different points along their respective arcuate paths of oscillation. Also, the axis of oscillation deviates slightly from the vertical. Therefore, oscillation effectively varies the direction of discharged air with respect to both horizontal and vertical directions, and to be either parallel in both fans, or divergent.

Certain additional features are provided to render the fan more useful to consumers. Air filters are placed in the air stream to assist in delivering air free of dust, pollen, and other airborne contaminants.

Also, certain manual and automatic controls are provided. The controls include speed selection, on-off control by a contact sensitive control, and thermostatic control. The former two control features enable a user to operate the fan according to whim. The latter feature enables the fan to ventilate when a predetermined temperature is experienced, and to cease ventilation automatically should the fresh air be objectionably cold or warm. Thermostatic control assists in conserving heat in the winter, and in avoiding counterproductive ventilation during the summer.

Accordingly, it is a principal object of the invention to provide a window fan which oscillates.

It is another object of the invention to minimize fan performance losses due to extreme angle of baffles or blades of an air diffuser.

It is a further object of the invention to vary the direction of discharged air in both horizontal and vertical directions.

Still another object of the invention is to cause air flow which is selectively parallel from plural fans, or divergent from plural fans.

An additional object of the invention is that the axis of oscillation of each fan vary from the vertical.

A still further object of the invention is to minimize the height of the fan.

It is again an object of the invention to provide air filters for filtering incoming fresh air.

Yet another object of the invention is to provide on-off control by touch, speed selection, and on-off control responsive to temperature.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
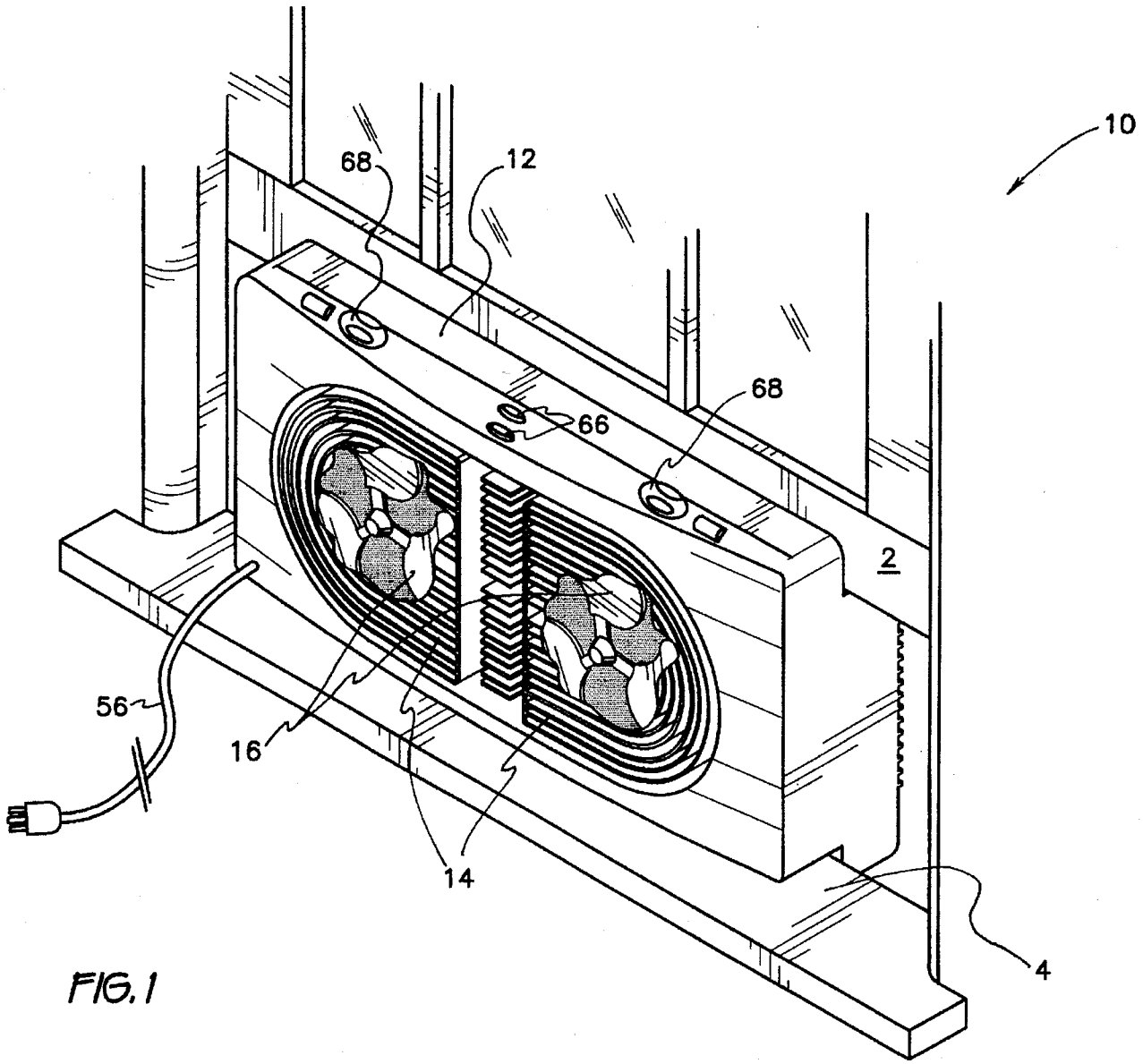
FIG. 1 is an environmental, front perspective view of the novel window fan.

FIG. 1 shows novel window fan 10 installed in a window 2. Window 2 closes over fan 10, pinning it in place by entrapping housing 12 against window sill 4. Two diffusers 14 are provided, each covering a respective fan, represented by fan blades 16. Operator control knobs are located on the top of housing 12. Two fans are disposed abreast of one another, so that the overall height of fan 10 is limited, and also so that air can be distributed simultaneously in several directions. Even more fans could be provided, if desired.

Figure 2:
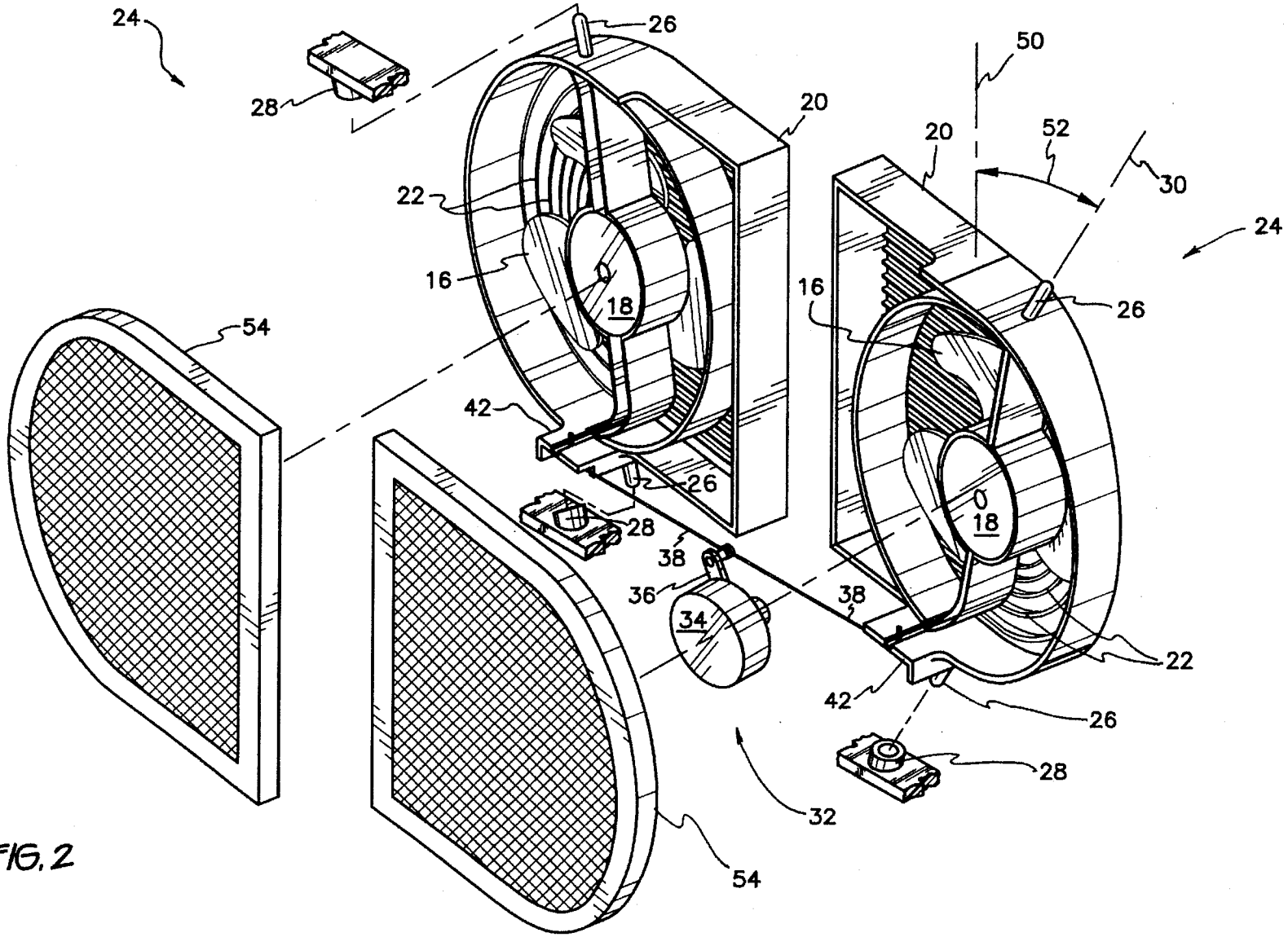
FIG. 2 is a partially exploded, perspective detail view of internal components of FIG. 1.

Fans 16 and related components are better seen in FIG. 2. Each fan comprises a blower module 24 including fan blade 16 for generating air flow, a motor 18 for driving its associated fan blade 16, and a shroud 20. Shroud 20 assists in directing air flow, and supports diffusion slats 22. Shroud 20 and slats 22 will be referred to hereinafter as diffuser 14, and also supports pivot pintles 26. Pintles 26 are journaled within sockets 28 fixed to housing 12.

Slats 22 of diffuser 14 are located downstream of fan blades 16, and oriented so as to direct air flow directly outwardly from fan blades 16. Slats 22 are fixed or stationary in their orientation with respect to fan blade 16 by virtue of being forming an integral part of shroud 20, which surrounds and supports motor 18 and its associated fan blade 16. Therefore, diffuser 14 is fixed with respect to fan blade 16.

Rather than having adjustable diffusers to redirect air, blower modules 24 are automatically and continuously oscillated or pivoted about an axis 30 of oscillation. Each blower module 24 sweeps through an arc, then reverses its pivoting motion, thereby establishing a repeating pattern. Both blower modules 24 are driven in this manner by a single oscillating mechanism 32. Oscillating mechanism 32 comprises a gearmotor 34 having a crank 36 (which will be understood to include its associated arm), and linkage connecting crank 36 to each shroud 20.

In the embodiment of FIG. 2, the linkage comprises two connecting rods 38 each engaging crank 36 at their respective proximal ends, and engaging a tab 42 secured to shroud 20 at their respective distal ends. Engagement at tab 42 is spaced apart from axis 30, so that operable leverage is achieved.

Figure 3:
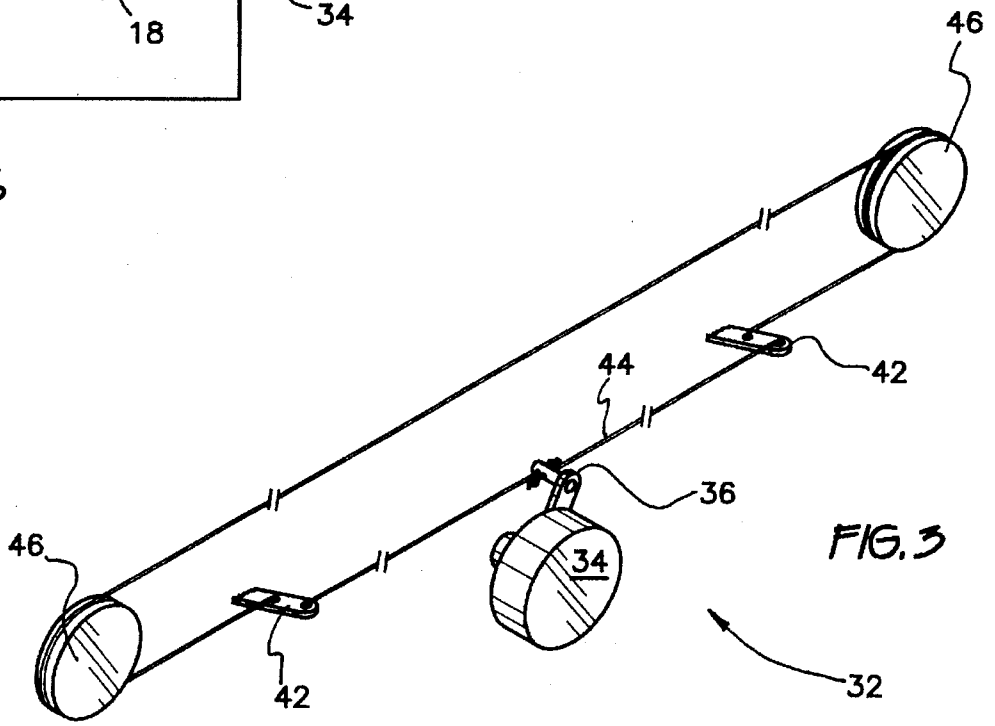
FIG. 3 is a perspective detail view of an alternative embodiment of the oscillation mechanism, wherein fans oscillate in tandem.

Other linkages are possible. As shown in FIG. 3, it would be possible to substitute a flexible cord 44 or the like for rods 38 of the embodiment of FIG. 2. In the embodiment of FIG. 3, guide rollers 46 would be provided and fixed to housing 12 so that cord 44 could alternately draw tabs 42 in opposite directions.

Figure 4:
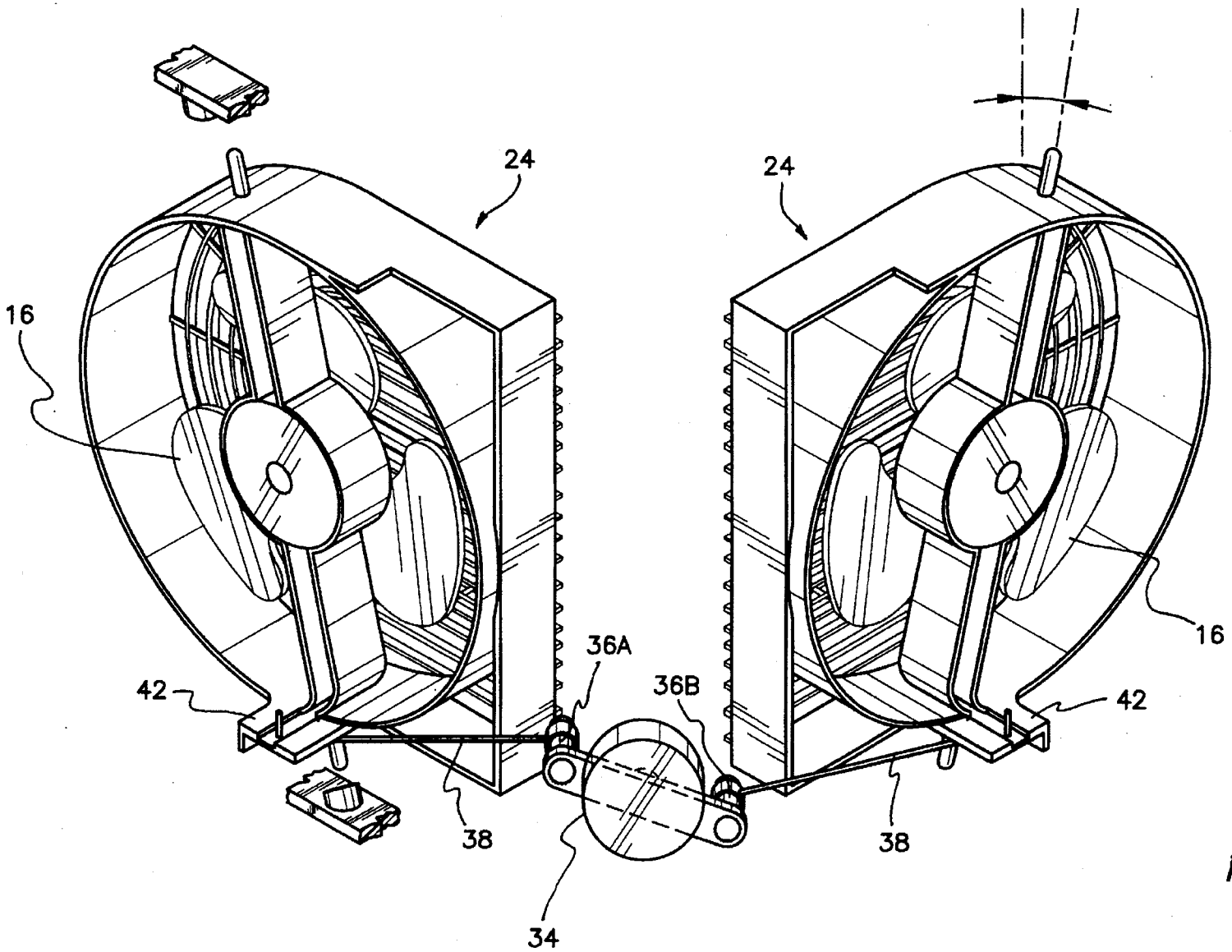
FIG. 4 is a partially exploded, perspective detail view of still another embodiment of the oscillation mechanism, wherein the fans diverge and converge.

Referring now to FIG. 4, other oscillation schemes are possible. In this embodiment, gearmotor 34 has twin cranks 36A,36B located diametrically opposed from one another. Blower modules 24 will face different directions at any one time (except, of course, at one point in the cycle when both blower modules 24 face straight forwardly). Connecting rods 38 will consequently drive their respective fans symmetrically, but in opposite directions from one another. This has the effect of breaking up or diffusing the united or parallel air flow arising from the oscillation scheme of FIG. 2. The effect of a single, strong draft resulting from the embodiment of FIG. 2 is thus somewhat overcome by the arrangement of FIG. 4.

Fan 10 may be provided either with one of the crank arrangements set forth above installed permanently, or may have easily a readily replaceable crank arrangement so that either crank 36 or a component having twin cranks 36A,36B may be selectively employed by the user.

Figure 5:
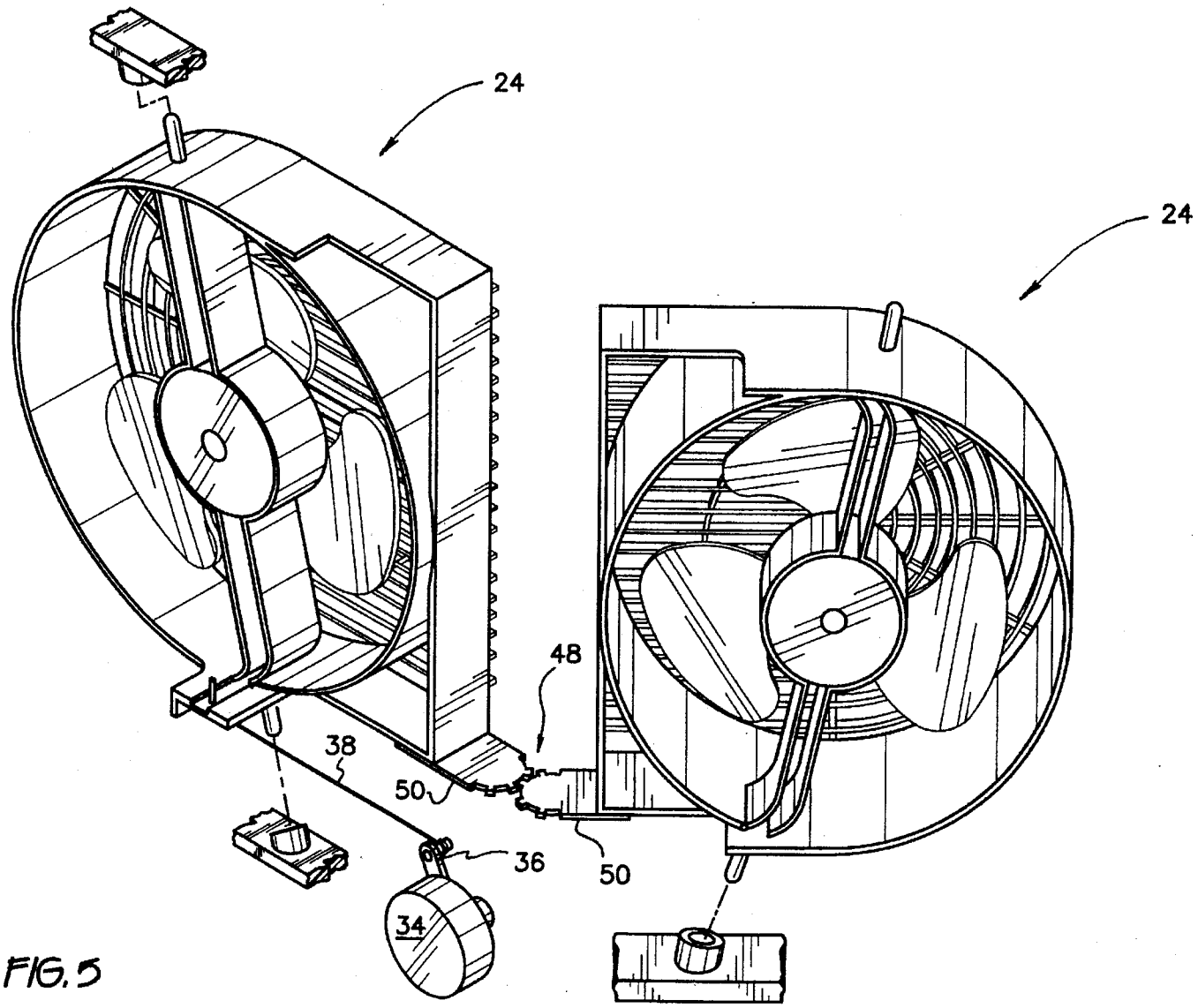
FIG. 5 is a partially exploded, perspective detail view of still another embodiment of the oscillation mechanism, wherein the fans diverge and converge.

FIG. 5 illustrates another method of varying opposed oscillation in the manner of FIG. 4. In the embodiment of FIG. 5, one blower module 24 is driven by connecting rod 38 from crank 36 of gearmotor 34. Blower modules 24 are provided with intermeshing gears 48 disposed upon complementary arms 50. In this embodiment, one blower module 24 is oscillated by gearmotor 34, and the other blower module 24 is, in turn, driven by the first blower module 24.

Returning to FIG. 2, it will be seen that axis 30 is inclined or offset slightly from a vertical direction, the vertical being indicated at 50. The angle 52 of discrepancy between axis 30 and vertical direction 50 is preferably 11degrees, although this may be modified as desired. This arrangement causes oscillation to vary the direction of air flow with respect to both the horizontal direction and the vertical direction simultaneously. Forced air from fan 10 therefore more thoroughly permeates the room being ventilated.

Also seen in FIG. 2, air filters 54 are disposed within the air flow of each blower module 24. Filters 54 may be slidably and removably carried within shroud 20 by grooves (not shown), or may be fastened thereagainst by screws or other fasteners (not shown). Alternatively, filters 54 may be secured to housing 12. If the latter arrangement is selected, a single large filter (not shown) may be employed.

Figure 6:
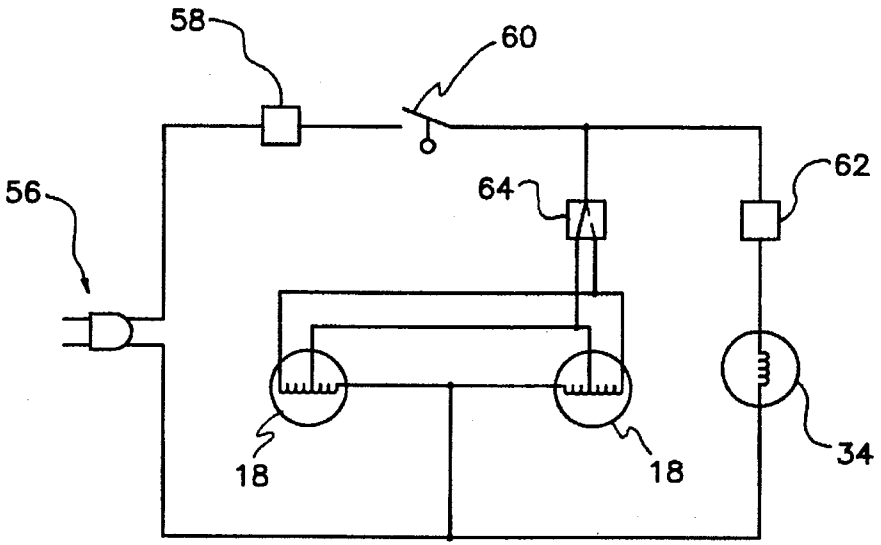
FIG. 6 is a schematic diagram of the power and control circuit.

FIG. 6 illustrates a preferred electrical control circuit. Power is conducted to fan 10 from a power cord and plug 56. A contact or touch responsive operator's on-off switch 58 is provided. Touch responsive switches operating by capacitance are well known in the art, and will therefore not be described in greater detail herein. Located in series with switch 58 is a thermostatic on-off switch 60 which responds to detection of a predetermined temperature. Switches 58 and 60 govern all functions.

A second touch responsive on-off switch 62 controls oscillation by making and breaking electrical power to gearmotor 34. As seen in FIG. 6, oscillation is controlled independently of fan operation. Finally, a speed selector switch 64 for varying fan speed is also provided. Switch 64 is arranged to control all fan motors 18 simultaneously.

Returning now to FIG. 1, touch pads 66 and control knobs 68 for controlling switches 58,60,62,64 are conveniently located at the top of housing 12.

It will be apparent to one of skill in the art that the present invention is susceptible to various modifications which may be introduced without departing from the inventive concept. For example, any number of fans may be provided. These fans may be oriented other than abreast of one another.

Also, any suitable control scheme will operate the novel window fan. The types and arrangements of switches may vary. For example, touch type controls may be deleted in favor of toggle, dial, or button operated switches, or in favor of still other types of controls.

It is to be understood that the present invention is not limited to the embodiments described above, but encompasses any and all embodiments within the scope of the following claims.

We claim:

1. A window fan comprising:

a housing for supporting said window fan in a window;

a fan assembly including a motor and a fan blade for generating air flow, said fan assembly further comprising a diffuser fixed in orientation with respect to said fan blade; and oscillation means for causing said fan assembly to oscillate automatically with respect to said housing.

2. The window fan according to claim 1, said oscillation means further including pivot means having an axis of oscillation which allows said fan assembly to pivot about said axis of oscillation.

3. The window fan according to claim 2, said oscillation means comprising a gearmotor having a crank, and a connecting rod having a proximal end attached to said crank and a distal end attached to said fan assembly at a point spaced apart from said axis of oscillation.

4. The window fan according to claim 2, said axis of oscillation being inclined from a vertical direction, whereby oscillation varies direction of said air flow from said window fan with respect to both horizontal and vertical directions.

5. The window fan according to claim 1, having another fan assembly including another motor and another fan for generating air flow disposed abreast of the other fan assembly whereby the height dimension of said window fan is minimized.

6. The window fan according to claim 5, further comprising directional means for causing said fan assemblies to discharge said air flow in different directions.

7. The window fan according to claim 1, further comprising an air filter disposed within air flow of said fan assembly.

8. The window fan according to claim 1, further comprising a control circuit having a touch responsive on-off switch.

9. The window fan according to claim 1, further comprising a control circuit having means for varying fan speed.

10. The window fan according to claim 1, further comprising a control circuit having an on-off switch responsive to detection of a predetermined temperature.

11. A window fan comprising:

a housing for supporting said window fan in a window;

a plurality of fan assemblies disposed abreast of one another, each one of said fan assemblies including a motor, a fan blade for generating air flow, and a diffuser including a shroud and a plurality of diffusion slats, said slats being located downstream of said fan blade with respect to the direction of said air flow, said diffuser having means permanently fixing said diffuser in its orientation with respect to said fan blade; and oscillation means for causing said fan assemblies to oscillate automatically with respect to said housing, said oscillation means comprising pivot means having an axis of oscillation which allows said fan assemblies to pivot about said axis of oscillation in a direction inclined from a vertical direction, whereby oscillation varies direction of said air flow from said window fan with respect to both horizontal and vertical directions, and a gearmotor having a crank, said crank being connected to each of said fan assemblies at a point spaced apart from said axis of oscillation.

12. The window fan according to claim 11, further comprising directional means for causing said fan assemblies to discharge said air flow in different directions.

13. The window fan according to claim 11, further comprising an air filter disposed within air flow of said fan assemblies.

14. The window fan according to claim 11, further comprising a control circuit having a touch responsive on-off switch.

15. The window fan according to claim 11, further comprising a control circuit having means for varying fan speed.

16. The window fan according to claim 11, further comprising a control circuit having an on-off switch responsive to detection of a predetermined temperature.

17. A window fan comprising:

a housing for supporting said window fan in a window;

a plurality of fan assemblies disposed abreast of one another, each one of said fan assemblies including a motor, a fan blade for generating air flow, and a diffuser including a shroud and a plurality of diffusion slats, said slats being located downstream of said fan blade with respect to the direction of said air flow, said diffuser having means permanently fixing said diffuser in its orientation with respect to said fan blade;

oscillation means for causing said fan assemblies to oscillate automatically with respect to said housing, said oscillation means further including pivot means having an axis of oscillation which allows said fan assemblies to pivot about said axis of oscillation in a direction inclined from a vertical direction, whereby oscillation varies direction of said air flow from said window fan with respect to both horizontal and vertical directions;

an air filter disposed within air flow of said fan assemblies; and a control circuit having a touch responsive on-off switch, means for varying fan speed, and an on-off switch responsive to detection of a predetermined temperature.

* * * * *